US009427054B1

(12) United States Patent
Al-Saleh

(10) Patent No.: US 9,427,054 B1
(45) Date of Patent: Aug. 30, 2016

(54) INFLATABLE COIN BANK

(71) Applicant: Ahmad A. Al-Saleh, Safat (KW)

(72) Inventor: Ahmad A. Al-Saleh, Safat (KW)

( * ) Notice: Subject to any disclaimer, the term of this patent is extended or adjusted under 35 U.S.C. 154(b) by 0 days.

(21) Appl. No.: 15/065,822

(22) Filed: Mar. 9, 2016

(51) Int. Cl.
*A45C 1/12* (2006.01)
*A63H 3/00* (2006.01)

(52) U.S. Cl.
CPC ..... *A45C 1/12* (2013.01); *A63H 3/005* (2013.01)

(58) Field of Classification Search
CPC ..... A45C 1/12; E05G 1/005; A63H 3/005; A63H 3/06
USPC ..... 232/4 R; 446/8, 9, 226
See application file for complete search history.

(56) References Cited

U.S. PATENT DOCUMENTS

| | | | | |
|---|---|---|---|---|
| 2,448,807 A * | 9/1948 | Kimball | A45C 1/12 446/8 |
| 2,768,472 A * | 10/1956 | Whalen | A63H 33/00 416/189 |
| 2,779,128 A * | 1/1957 | West | A45C 1/12 232/4 R |
| 3,880,279 A * | 4/1975 | Gambel | A63B 43/00 206/0.8 |
| 4,401,259 A | 8/1983 | Knutson | |
| 4,718,738 A | 1/1988 | Bell | |
| D296,604 S | 7/1988 | Brummett | |
| D591,025 S | 4/2009 | Kan | |
| 2006/0292956 A1 | 12/2006 | Sayles | |
| 2008/0233829 A1 | 9/2008 | Sayles | |
| 2015/0034712 A1 | 2/2015 | Moore | |

FOREIGN PATENT DOCUMENTS

| | | |
|---|---|---|
| CN | 202365011 U | 8/2012 |
| JP | 2015-108 A | 1/2015 |

* cited by examiner

*Primary Examiner* — William Miller
(74) *Attorney, Agent, or Firm* — Richard C. Litman

(57) ABSTRACT

The inflatable coin bank is a decorative coin bank which grows in size with each coin inserted and stored therein. The inflatable coin bank includes a flexible housing with a coin receptacle received therein. The receptacle has a slot formed therethrough for receiving the coins. A sensor is mounted adjacent the slot formed through the receptacle for selectively generating an actuation signal when a coin passes through the slot. An inflatable bladder is further received within the flexible housing. An air pump is in communication with the inflatable bladder and the sensor, such that the air pump partially inflates the inflatable bladder with a pre-determined volume of air when the sensor generates the actuation signal. In this way, the inflatable bladder grows in volume with each insertion of a coin through the slot.

18 Claims, 3 Drawing Sheets

INFLATABLE COIN BANK

BACKGROUND OF THE INVENTION

1. Field of the Invention

The present invention relates generally to banks for coins and the like, and particularly to a decorative coin bank which is inflatable for providing a visual indication of volume of coins stored therein.

2. Description of the Related Art

Decorative coin banks, such as so-called "piggy banks" and the like, are typically formed from rigid opaque materials, such as ceramic, plastic, metal or the like. Despite their traditional usage for saving and storing coins, such banks have the drawback that there is no visual indication of how much money is stored therein. In order to determine, or even estimate, the value of coins saved in the bank, the bank must be opened, which may involve a mechanical process which is difficult for the typical child user. Thus, an inflatable coin bank addressing the aforementioned problems is desired.

SUMMARY OF THE INVENTION

The inflatable coin bank is a decorative coin bank, at least a portion of which grows in size with each coin inserted and stored therein. The inflatable coin bank includes a flexible housing, which is preferably decorative, such as, for example, that of a stuffed animal or the like. A receptacle is received within the flexible housing for storing coins. The receptacle has a slot formed therethrough for receiving the coins to be stored in the receptacle. A door in the receptacle provides selective access to the interior of the receptacle for accessing the stored coins. A sensor is mounted adjacent the slot formed through the receptacle for selectively generating an actuation signal when a coin passes through the slot.

An inflatable bladder is further received within the flexible housing. An air pump is in communication with the inflatable bladder and the sensor, such that the air pump partially inflates the inflatable bladder with a pre-determined volume of air when the sensor generates the actuation signal. In this way, the inflatable bladder grows in volume with each insertion of a coin through the slot. Using the example of a stuffed animal as the housing, the stuffed animal appears to grow in size with each insertion of a coin. A deflation valve selectively seals the inflatable bladder. The deflation valve is coupled with the door such that the deflation valve is opened when the door is opened, thus causing the inflatable bladder to deflate when the door is opened for coin removal.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
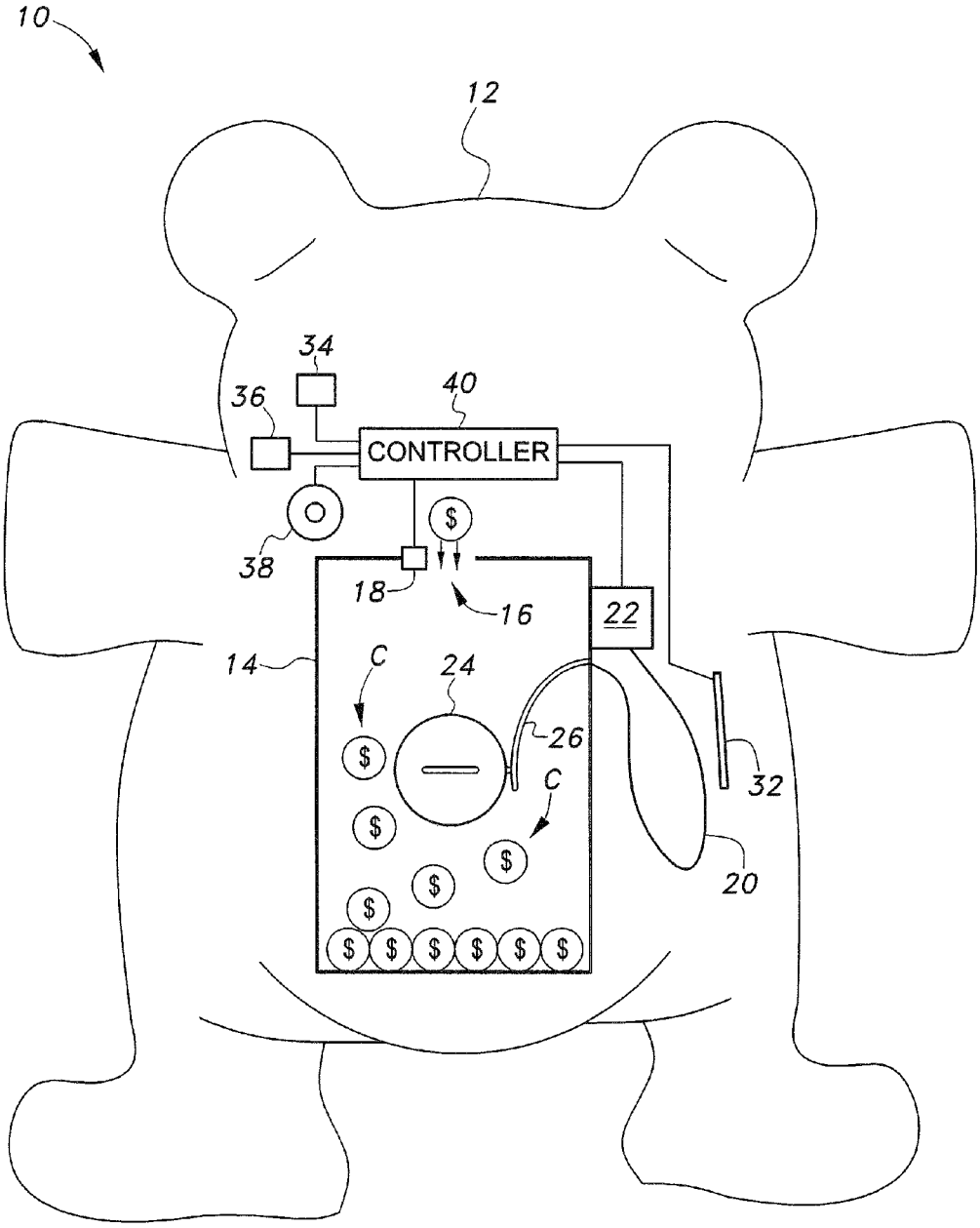
FIG. 1 diagrammatically illustrates an inflatable coin bank according to the present invention.
Figure 2:
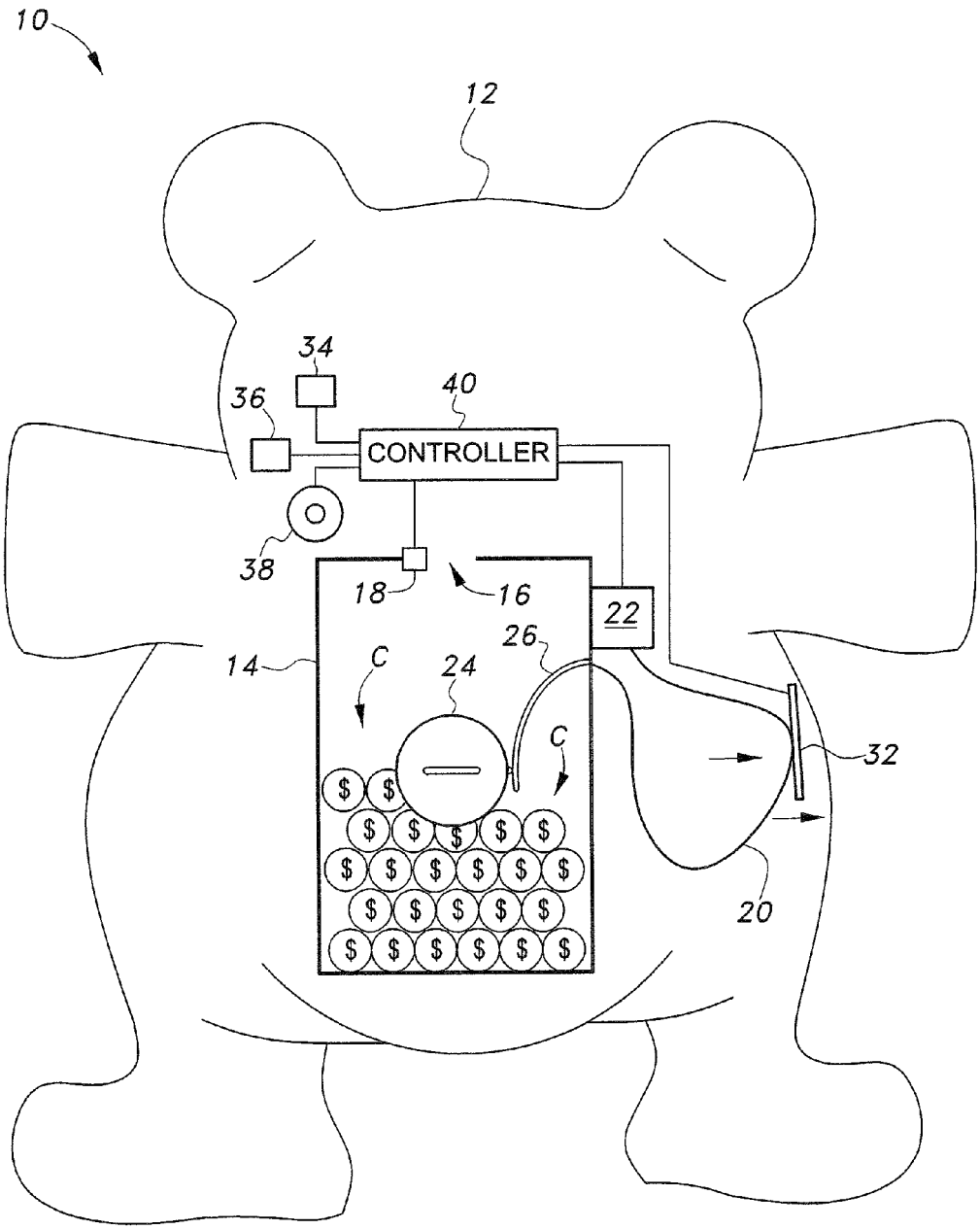
FIG. 2 diagrammatically illustrates the inflatable coin bank of FIG. 1 in an inflated configuration.

The inflatable coin bank 10 is a decorative coin bank which grows in size with each coin C inserted and stored therein. The inflatable coin bank 10 includes a flexible housing 12, which is preferably decorative. In the example of FIGS. 1 and 2, the flexible housing 12 is similar to that of a stuffed animal. It should be understood that the flexible housing 12 may have any desired size, shape or appearance, and may be stuffed with any desired material, such as conventional polystyrene beads, cotton fiber, or the like. Additionally, it should be understood that the inflatable coin bank 10 may be used to store and save any suitable type of coin or other currency, and that coins C are shown for exemplary purposes only.

A receptacle 14 is received within the flexible housing 12 for storing coins C. It should be understood that the substantially rectangular receptacle 14 is shown for exemplary purposes only and that receptacle 14 may be any suitable type of receptacle such as those commonly found in coin banks. The receptacle 14 has a slot 16 formed therethrough for receiving the coins C to be stored therein. It should be understood that the positioning of slot 16 relative to receptacle 14 is shown for exemplary purposes only, and that slot 16 may be located in any desired location, and may be accessed through flexible housing 12 in any suitable way, dependent upon the nature of flexible housing 12.

As shown, a door 24 in the receptacle 14 provides selective access to the interior of the receptacle 14 for accessing the stored coins C, similar to a conventional coin bank. It should be understood that door 24 is shown for exemplary purposes only, and may have any desired size, overall contour or positioning relative to receptacle 14. Further, a sensor 18 is mounted adjacent the slot 16 formed through the receptacle 14 for selectively generating an actuation signal when a coin C passes through the slot 16. It should be understood that sensor 18 may be any desired type of sensor for detecting the passage of coin C, such as an optical sensor, a mechanical sensor, an inductive sensor or the like.

An inflatable bladder 20 is further received within the flexible housing 12. It should be understood that the inflatable bladder 20 is shown for exemplary purposes only and may have any suitable positioning within flexible housing 12, relative to receptacle 14. It should further be understood that inflatable bladder 20 may have any suitable size or overall contouring, and may be formed from any desired material which is inflatable and airtight. An air pump 22 is in communication with the inflatable bladder 20 and the sensor 18, such that the air pump 22 partially inflates the inflatable bladder 20 with a pre-determined volume of air when the sensor 18 generates the actuation signal. In this way, the inflatable bladder 20 grows in volume with each insertion of a coin C through the slot 16. Using the example of a stuffed animal as the housing 12, the stuffed animal appears to grow in size with each insertion of a coin C through slot 16. In FIG. 2, the inflatable bladder 20 is shown with an increased volume corresponding to the increased number of coins C stored in receptacle 14. It should be understood that inflatable bladder 20 may be in fluid communication with air pump 22 in any suitable manner, including any desired valving, such as a one-way valve, tubes, hoses, linkages or the like. Further, it should be understood that any suitable type of air pump or other source of pressured air may be utilized.

As shown, sensor 18 may communicate with air pump 22 through a separate controller 40. Controller 40 may be any suitable type of control circuitry, microprocessor, programmable logic controller or the like. Controller 40 receives the actuation signal from sensor 18 and generates an output signal for actuating air pump 22 for a pre-set duration of time in order to fill the inflatable bladder 20 with the pre-determined volume of air.

Additionally, a pressure sensor 32 (or any other suitable type of contact sensor or the like) may be further received within the flexible housing 12, as shown. The pressure sensor 32 is positioned such that when the inflatable bladder 20 reaches a pre-determined maximum volume, the air pump 22 is deactivated. For a contact-type sensor, such as in the example of FIG. 2, when inflatable bladder 20 contacts the sensor 32, sensor 32 generates a signal which is received by controller 40. Controller 40 then prevents the air pump 22 from further inflating the inflatable bladder 20. It should be understood that any suitable type of sensor or switching mechanism may be used to detect when inflatable bladder 20 reaches the pre-determined maximum volume, such as a pressure plate, a contact switch, a gas pressure sensor for measuring the pressure inside inflatable bladder 20, or the like.

In addition to the inflation of the inflatable bladder 20, one or more signaling devices may also be in communication with sensor 18, through controller 40. For example, visual indicators 34, 36, which may be light emitting diodes (LEDs) of different colors or the like, may be actuated with each insertion of a coin C. Alternatively, or in addition to, an audio signaling device 38, such as a speaker or the like, may further provide audio signaling when the coin C passes through the slot 16. It should be understood that controller 40 may be programmed to generate distinct visual and/or auditory patterns or signals.

Figure 3:
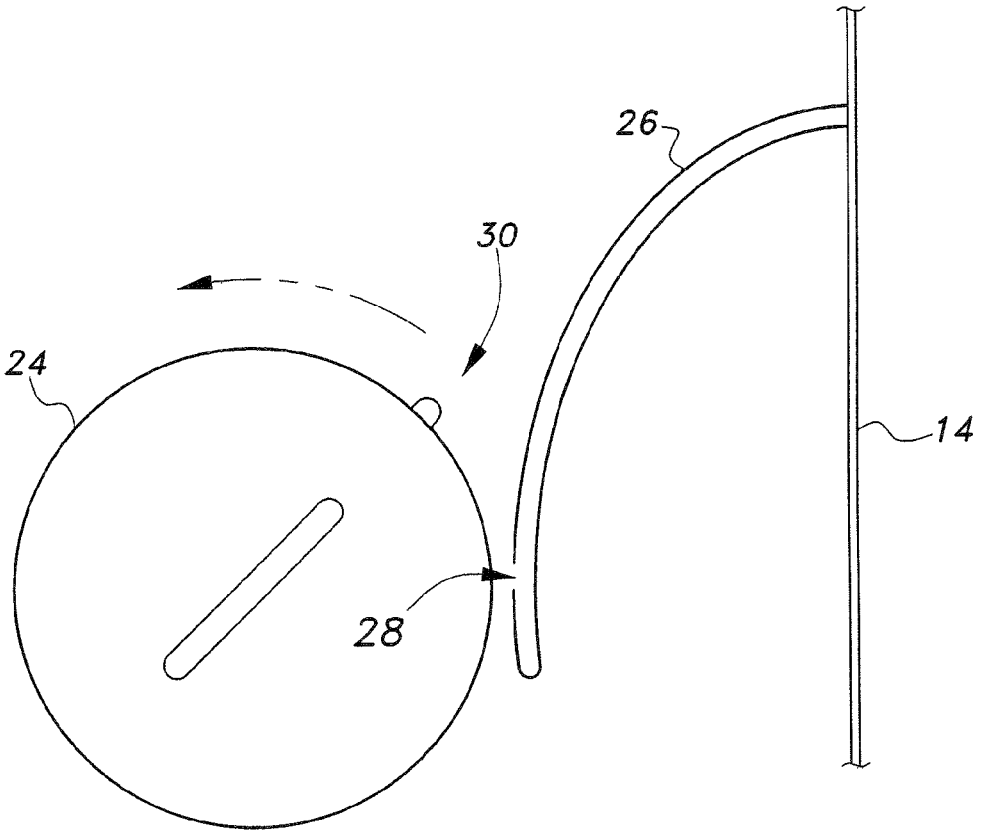
FIG. 3 diagrammatically illustrates actuation of a deflation valve of the inflatable coin bank.

A deflation valve 26 preferably selectively seals the inflatable bladder 20. As best shown in FIG. 3, the deflation valve 26 is coupled with the door 24 such that the deflation valve 26 is opened when the door 24 is opened. In the closed configuration of FIGS. 1 and 2, the seal 30 fixed to door 24 covers opening 28 of deflation valve 26. When door 24 is rotated to open the door, as in the configuration shown in FIG. 3, the seal 30 is rotated away from opening 28, thus opening the valve 26. This causes the inflatable bladder 20 to deflate when the door 24 is opened for coin removal. It should be understood that the rotating circular door 24 is shown for exemplary purposes only, and that any suitable type of door, and any corresponding linkage between the door and the deflation valve, may be utilized for selective deflation of inflatable bladder 20 when the door is opened.

It is to be understood that the present invention is not limited to the embodiments described above, but encompasses any and all embodiments within the scope of the following claims.

I claim:

1. An inflatable coin bank, comprising:

a flexible housing;

a receptacle received within said flexible housing, said receptacle having a slot formed therethrough for receiving coins to be stored in said receptacle;

a sensor mounted adjacent the slot formed through said receptacle for selectively generating an actuation signal when a coin passes through the slot;

an inflatable bladder received within said flexible housing;

an air pump in communication with said inflatable bladder and said sensor, such that said air pump partially inflates said inflatable bladder with a pre-determined volume of air when said sensor generates the actuation signal; and a controller operatively coupled to at least said sensor to facilitate the communication of the sensor and the air pump.

2. The inflatable coin bank as recited in claim 1, further comprising a door for providing selective access to an interior of said receptacle.

3. The inflatable coin bank as recited in claim 2, further comprising a deflation valve for selectively sealing said inflatable bladder, the deflation valve being coupled with the door such that the deflation valve is opened when the door is opened.

4. The inflatable coin bank as recited in claim 1, further comprising a pressure sensor received within said flexible housing, wherein when said inflatable bladder reaches a pre-determined maximum volume, said air pump is deactivated.

5. The inflatable coin bank as recited in claim 1, further comprising at least one signaling device in communication with said sensor, such that the at least one signaling device generates a sensory signal when the coin passes through the slot.

6. The inflatable coin bank as recited in claim 5, wherein the at least one signaling device comprises at least one visual indicator.

7. The inflatable coin bank as recited in claim 6, wherein the at least one signaling device further comprises an audio indicator.

8. An inflatable coin bank, comprising:

a flexible housing;

a receptacle received within said flexible housing, said receptacle having a slot formed therethrough for receiving coins to be stored in said receptacle;

a controller;

a sensor mounted adjacent the slot formed through said receptacle for selectively generating an actuation signal when a coin passes through the slot;

wherein the actuation signal being received by said controller;

at least one signaling device in communication with said sensor via said controller, such that the at least one signaling device generates a sensory signal when the coin passes through the slot;

wherein the sensory signal being responsive to said actuation signal of said sensor;

an inflatable bladder received within said flexible housing; and an air pump in communication with said inflatable bladder and said sensor via said controller, such that said air pump partially inflates said inflatable bladder with a pre-determined volume of air when said sensor generates the actuation signal;

wherein said controller activates said air pump to pump the pre-determined volume of air.

9. The inflatable coin bank as recited in claim 8, further comprising a door for providing selective access to an interior of said receptacle.

10. The inflatable coin bank as recited in claim 9, further comprising a deflation valve for selectively sealing said inflatable bladder, the deflation valve being coupled with the door such that the deflation valve is opened when the door is opened.

11. The inflatable coin bank as recited in claim 8, further comprising a pressure sensor received within said flexible housing, wherein when said inflatable bladder reaches a pre-determined maximum volume, said air pump is deactivated.

12. The inflatable coin bank as recited in claim 8, wherein the at least one signaling device comprises at least one visual indicator.

13. The inflatable coin bank as recited in claim 8, wherein the at least one signaling device further comprises an audio indicator.

14. An inflatable coin bank, comprising:

a flexible housing;

a receptacle received within said flexible housing, said receptacle having a slot formed therethrough for receiving coins to be stored in said receptacle;

a door for providing selective access to an interior of said receptacle;

a sensor mounted adjacent the slot formed through said receptacle for selectively generating an actuation signal when a coin passes through the slot;

an inflatable bladder received within said flexible housing;

an air pump in communication with said inflatable bladder and said sensor, such that said air pump partially inflates said inflatable bladder with a pre-determined volume of air when said sensor generates the actuation signal;

a deflation valve for selectively sealing said inflatable bladder, the deflation valve being coupled with the door such that the deflation valve is opened when the door is opened; and a controller for receiving the actuation signal from said sensor, and operating the air pump in response to receipt of the actuation signal.

15. The inflatable coin bank as recited in claim 14, further comprising a pressure sensor received within said flexible housing, wherein when said inflatable bladder reaches a pre-determined maximum volume, said air pump is deactivated.

16. The inflatable coin bank as recited in claim 14, further comprising at least one signaling device in communication with said sensor, such that the at least one signaling device generates a sensory signal when the coin passes through the slot.

17. The inflatable coin bank as recited in claim 16, wherein the at least one signaling device comprises at least one visual indicator.

18. The inflatable coin bank as recited in claim 16, wherein the at least one signaling device further comprises an audio indicator.

* * * * *